US007394404B2

(12) United States Patent
Kim

(10) Patent No.: US 7,394,404 B2
(45) Date of Patent: Jul. 1, 2008

(54) SYSTEM AND METHOD FOR CONTROLLING PUBLIC TRANSPORTATION

(75) Inventor: Jae-Ho Kim, B-502, Artville Apt, 4560, Daeya-dong, Siheung-si, Gyeonggi-do (KR)

(73) Assignee: Jae-Ho Kim, Gyeonggi-Do (KR)

( * ) Notice: Subject to any disclaimer, the term of this patent is extended or adjusted under 35 U.S.C. 154(b) by 329 days.

(21) Appl. No.: 11/228,799

(22) Filed: Sep. 16, 2005

(65) Prior Publication Data

US 2006/0074545 A1 Apr. 6, 2006

(30) Foreign Application Priority Data

Sep. 17, 2004 (KR) ..... 10-2004-0074616

(51) Int. Cl.
*G08G 1/123* (2006.01)

(52) U.S. Cl. ..... 340/994; 340/991; 701/117

(58) Field of Classification Search ..... 340/994, 340/988, 991, 993; 701/117
See application file for complete search history.

(56) References Cited

U.S. PATENT DOCUMENTS

| | | | | |
|---|---|---|---|---|
| 4,220,946 | A * | 9/1980 | Henriot | 340/994 |
| 4,791,571 | A * | 12/1988 | Takahashi et al. | 701/117 |
| 5,739,774 | A * | 4/1998 | Olandesi | 340/994 |
| 6,374,176 | B1 * | 4/2002 | Schmier et al. | 701/200 |
| 6,803,862 | B2 * | 10/2004 | O'Connor et al. | 340/994 |
| 6,958,709 | B2 * | 10/2005 | Izbicki et al. | 340/994 |

* cited by examiner

*Primary Examiner*—Brent Swarthout
(74) *Attorney, Agent, or Firm*—David W. Carstens; Carstens & Cahoon, LLP

(57) ABSTRACT

A public transportation control system controls a suitable distance between public buses traveling on a road with traveling data of the buses through collection of the traveling data of the buses and transmission of transportation information of a target bus based on the traveling data to the target bus, and transmits the transportation information of the bus to respective bus stops on the basis of the collected traveling data of the bus in order to provide guidance of arrival schedule of the bus at the bus stops to passengers waiting for the bus, thereby preventing clumping of the buses and allowing the passengers to efficiently use a bus wait time through guidance of accurate transportation information.

18 Claims, 8 Drawing Sheets

Fig. 8

| Line No. 623 Bus No. 1257 Time 16:35 Data receipt time 16:32<br>Decelerate, Self-adjustment required | | | 331 |
|---|---|---|---|
| Leading bus No. 1256 | Content | Following bus No. 1256 | 332 |
| 10 | Number of bus stops | 10 | 333 |
| 5 | Traveling distance | 14 | 334 |
| + 2 (+ 18%) | Correction value(rate) | −4 (−40%) | 335 |
| Current travel correction value of this bus is +8. | | | 336 |

SYSTEM AND METHOD FOR CONTROLLING PUBLIC TRANSPORTATION

BACKGROUND OF THE INVENTION

1. Field of the Invention

The present invention relates to a system and a method for controlling public transportation. More particularly, the present invention relates to a system and a method for controlling public transportation, which can control a suitable traveling distance between public buses traveling on a road using traveling data of the buses through collection of the traveling data of the buses and transmission of transportation information of an associated bus based on the traveling data to the associated bus, and at the same time, can transmit the transportation information of the associated bus to respective bus stops on the basis of the collected traveling data of the bus in order to provide guidance of an arrival schedule of the associated bus at the bus stops to passengers waiting for the bus, thereby preventing clumping of the buses, and allowing the passengers to efficiently use a time for waiting for the bus through guidance of accurate transportation information.

2. Description of the Related Art

A public transportation management system has been already applied to the field of the art. However, the conventional public transportation management system is limited to management of traveling information of public buses only through information such as traveling times of the public buses, arrival and departure times of the buses for destinations on a line, current drivers of the buses, and the like, which can be collected only through on-board terminals after separating them from the stopped buses.

Thus, the conventional public transportation management system has problems in that speeding, deviation from the line, excessive stoppage at the bus stops, etc. of the buses are not absolutely managed by the system, causing frequent traffic accidents.

In addition, in order to keep traveling schedules under the conventional transportation management system, the drivers of the buses are inevitably forced to pass the bus stops irrespective of presence of passengers waiting at the bus stops, to intentionally delay traveling of the buses, or to arrive at the bus stops early or late, thereby increasing dissatisfaction of the passengers, resulting in decreased profits of bus companies.

In order to solve the problems as described above, some conventional public transportation management systems employ a satellite-based Global Positioning System (GPS). However, even in this case, there is a problem in that accuracy of information as to traveling locations of the buses is decreased in an urban area due to skyscrapers.

In other cases, some public transportation management systems employ Code Division Multiple Access (CDMA), but in this case, there is a problem in that communication costs are increased. In addition, when the public transportation management system employs Dedicated Short Range Communications (DSRC), information of traveling locations is discontinuous due to many shaded areas in the line, and rapid collection of information as to emergencies through the system is difficult. Thus, there is a difficulty in application of these systems to entire lines.

Moreover, since the conventional public transportation management systems described above are limited to the function of simple management of the transportation information, such as guidance of the traveling distance between the buses on the road, storage of the transportation information of the buses, etc., there is a problem in that the traveling distance between the buses becomes inconsistent if any one of the drivers drives without considering the transportation information. Thus, even when the circumstances as described above occur on the road, it is difficult to transmit instructions to the buses in order to correct the traveling disturbance between the buses. In addition, even if the transportation information is transmitted to the buses, the information has not been substantially used by the drivers due to severe errors in that information.

Furthermore, a currently commercialized radio base station has a problem in that transmission and receipt of the transportation information cannot be carried out in an area deviated from a communication region of the radio base station, resulting in failure of guidance for the public transportation of the entire lines.

SUMMARY OF THE INVENTION

The present invention has been made to solve the above problems, and it is an object of the present invention to provide a system and a method for controlling public transportation, which can realize real-time provision of information as to an optimum distance between public buses traveling on a road to the buses after receiving and analyzing traveling data of the buses, thereby ensuring a stable distance between the buses, and satisfactory public transportation for passengers, drivers and a bus company.

It is another object of the present invention to provide a system and a method for controlling public transportation, which can realize display of transportation information of public buses at respective bus stops or provision of the transportation information of the public buses over the Internet after receiving and analyzing traveling data of the buses, thereby enhancing efficiency of public transportation.

BRIEF DESCRIPTION OF THE DRAWINGS

The foregoing and other objects and features of the present invention will be more clearly understood from the following detailed description taken in conjunction with the accompanying drawings, in which:

FIG. 8 is a view illustrating one example of a transportation information display of the on-board terminal of the bus.

DESCRIPTION OF THE PREFERRED EMBODIMENTS

Preferred embodiments of the present invention will be described in detail with reference to the accompanying drawings.

Figure 1:
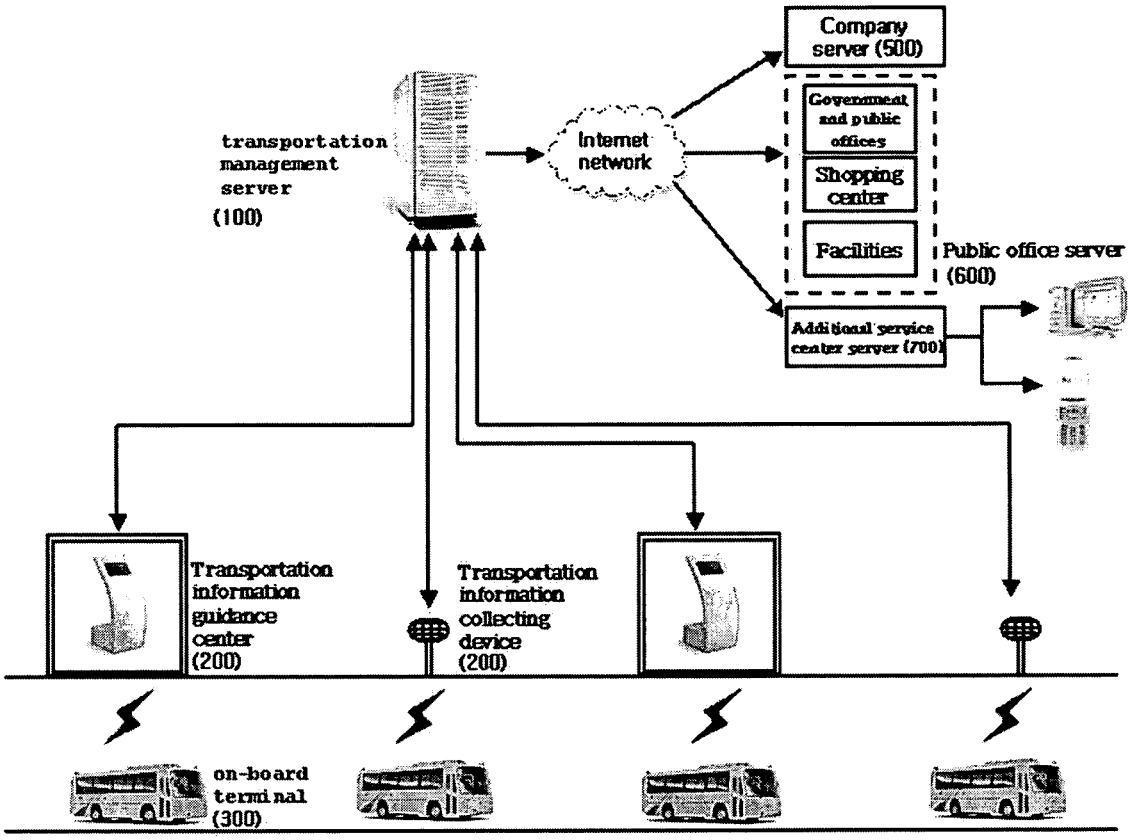
FIG. 1 is a diagram illustrating a public transportation control system in accordance with one embodiment of the present invention.

FIG. 1 is a diagram illustrating a public transportation control system in accordance with one embodiment of the present invention.

The public transportation control system of the invention is embodied through wireless communication. Referring to FIG. 1, the public transportation control system comprises an on-board terminal 300 equipped to each public bus traveling on a road to transmit bus information of the bus based on traveling conditions of the bus, and to display transportation information after receiving the transportation information based on the traveling information, a plurality of transportation information guidance centers 200 installed to bus stops to transmit the bus information as to traveling of the buses after collecting the bus information transmitted from the on-board terminals 300 of the buses traveling on the road and to transmit transportation information of an associated bus to an associated on-board terminal 300 and notify passengers waiting at the bus stops of transportation guidance information of the associated bus after receiving the transportation information and the transportation guidance information created by a transportation management server 100 on the basis of the bus information of the associated bus, and the transportation management server 100 to store the bus information as to the buses transmitted from the on-board terminals 300 of the buses through the transportation information guidance centers 200 after receiving the bus information through a dedicated communication network, and to transmit the transportation information and the transportation guidance information of the associated bus to the transportation information guidance centers 200 after creating the transportation information for adjusting a distance between the associated bus and other buses, and the transportation guidance information for notification of arrival schedule of the associated bus at the bus stops using the stored bus information. The public transportation control system of the invention further comprises a company server 500 to receive the transportation information transmitted from the transportation management server 100 over the Internet in order to allow the transportation information to be used for management of a bus company or to supply the transportation information as the public information, a public office server 600, and an additional service center server 700.

The configuration of the public transportation control system of the invention will be described in detail as follows.

The on-board terminal 300 is installed to each public bus to be controlled. The on-board terminal 300 transmits the bus information as to an associated bus traveling on the road to an associated transportation information guidance center 200, and receives the transportation information transmitted from the transportation information guidance center 200. Here, the transportation information comprises traveling distance adjustment information and the like.

At this time, the bus information transmitted from the on-board terminal 300 to the transportation information guidance center 200 comprises basic information including a bus number and a line number of the associated bus, road condition information as to construction and accident blocks, and bus condition information as to conditions of the bus such as last bus, defective bus or accident bus.

The road condition information and the bus condition information of the on-board terminal 300 are directly input by a driver of the bus according to the road conditions or the bus conditions.

The transportation information transmitted from the associated transportation information guidance center 200 to the on-board terminal 300 comprises leading/following-bus information as to a leading bus and a following bus with respect to the associated bus, a travel value to indicate traveling conditions of the associated bus, a travel correction value, and adjustment command information to adjust a suitable distance between the buses.

In other words, the on-board terminal 300 of the bus servers to transmit the traveling conditions of the bus to the transportation management server 100 via the transportation information guidance center 200, and to supply the transportation information transmitted from the transportation management server 100 to the driver, thereby enabling the driver of the bus to adjust distances between the associated bus and other buses running on the road with the transportation information.

Figure 2:
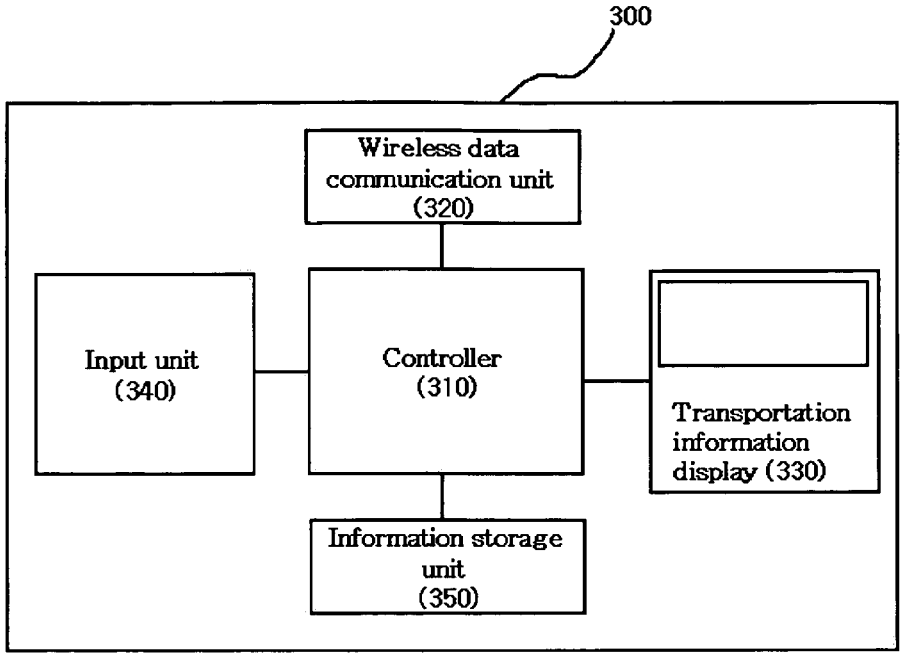
FIG. 2 is a diagram illustrating the configuration of an on-board terminal mounted on a public bus under the public transportation system.

Referring to FIG. 2, the configuration of the on-board terminal 300 will be described in detail as follows.

The on-board terminal 300 comprises an input unit 340 adapted to allow the driver to input the road condition information and the bus condition information or to operate the on-board terminal 300, an information storage unit 350 to store the basic information including the bus number and the line number, travel block information according to a line, and bus stop guidance information for an on-board broadcast, a wireless data communication unit 320 to transmit the basic information including the bus number and the line number to the transportation information guidance center 200 and to receive the transportation information transmitted from the transportation information guidance center 200, a transportation information display 330 to display the transportation information received through the wireless data communication unit 320 so as to notify the driver of the transportation information, and a controller 350 to assist transmission of the bus information and display of the transportation information by controlling the respective units described above.

One example of the transportation information displayed on the display 330 is shown in FIG. 8.

The transportation information is displayed on the transportation information display 330, and supplied to the driver. Referring to FIG. 8, the configuration of the transportation information on the display 330 comprises a bus information and command guidance section 331 to display various kinds of bus information, a receipt time of updated data, and a command from a manager of the line, a leading/following-bus guidance section 332 to display the information as to the leading bus and the following bus with respect to the associated bus, a distance guidance section 333 to display distances from the associated bus to the leading bus and to the following bus, a traveling distance guidance section 334 to display block travel times corresponding to distances from the associated bus to the leading bus and to the following bus, a leading/following-bus travel correction value guidance section 335 to display travel correction values of the leading and following buses with respect to the associated bus, and a self-travel correction value guidance section 336 to display a travel correction value of the associated bus.

When calculating the block travel times to be displayed on the traveling distance guidance section 334 as the information related to the distances from the associated bus to the leading bus and to the following bus, the transportation management server 100 calculates the distance between the associated bus and the leading bus by subtracting a time when the associated bus have immediately passed a point at a bus information collecting position from a time when the leading bus passed the point, and the distance between the associated bus and the following bus by subtracting a time when the following bus passed the point from the time when the target bus have passed the point.

The travel correction values of the leading and following buses are displayed on the leading/following-bus travel correction value guidance section 335 in order to urge all the drivers to keep a suitable distance in relation to other buses. In addition, a correction rate of each travel correction value is displayed together with the travel correction values, thereby preventing the drivers from disturbing smooth transportation with intension.

When displaying the travel correction value of the associated bus on the self-travel correction value guidance section 336, the travel correction value of the associated bus is provided as a positive or negative value obtained by subtracting the distance between the associated bus and the leading bus from a satisfactory travel value which is an average travel value of the leading buses.

The transportation information guidance centers 200 are installed to the bus stops for waiting the buses. Each of the transportation information guidance centers 200 transmits the bus information to the transportation management server 100 after receiving the bus information transmitted from the on-board terminal 300 of the bus. Then, the transportation information guidance centers 200 receive the transportation information for adjusting the distances, and the transportation guidance information for guiding an arrival schedule of a target bus, both of which are transmitted from the transportation management server 100. Then, each of the transportation information guidance centers 200 transmits the transportation information to an associated on-board terminal 300, and displays the transportation guidance information so as to allow the passengers waiting at the bus stops to obtain the arrival schedule of the bus.

At this time, the transportation guidance information transmitted from the transportation management server 100 to the transportation information guidance centers 200 comprises short distance arrival schedule information to notify that, since the target bus arrives at a bus stop immediately preceding to an associated bus stop or is running at a near position in a predetermined distance or less from the associated bus stop, the bus will arrive at the bus stop shortly. The transportation guidance information further comprises long distance arrival schedule information to notify arrival schedule of all public buses at the associated bus stop except for the short distance arrival scheduled buses, and subsidiary-bus stop arrival schedule information to notify arrival schedule of other buses, which travel along a similar line corresponding to a target line, at a subsidiary-bus stop of the similar line which is positioned near the associated bus stop of the target line.

The subsidiary-bus stop arrival schedule information comprises arrival schedules of other buses traveling on the similar line corresponding to the target line of the target bus, at which the other buses are scheduled to arrive at the subsidiary bus stop near the associated bus stop where the target bus arrives.

The subsidiary-bus stop arrival schedule information is provided for the purpose of enabling the passengers waiting at the bus stops to obtain information as to arrival of the other buses traveling on a line similar to the target lines at a bus stop near the target bus stop, i.e. at the subsidiary bus stop described above, and to use the other buses arriving at the subsidiary bus stop, if late arrival of the target bus is informed to the passengers at the bus stops. Standard for selecting the subsidiary bus stops is determined according to positions of bus stops on the respective lines and proximity of the bus stops with respect to the associated bus stops.

Figure 3:
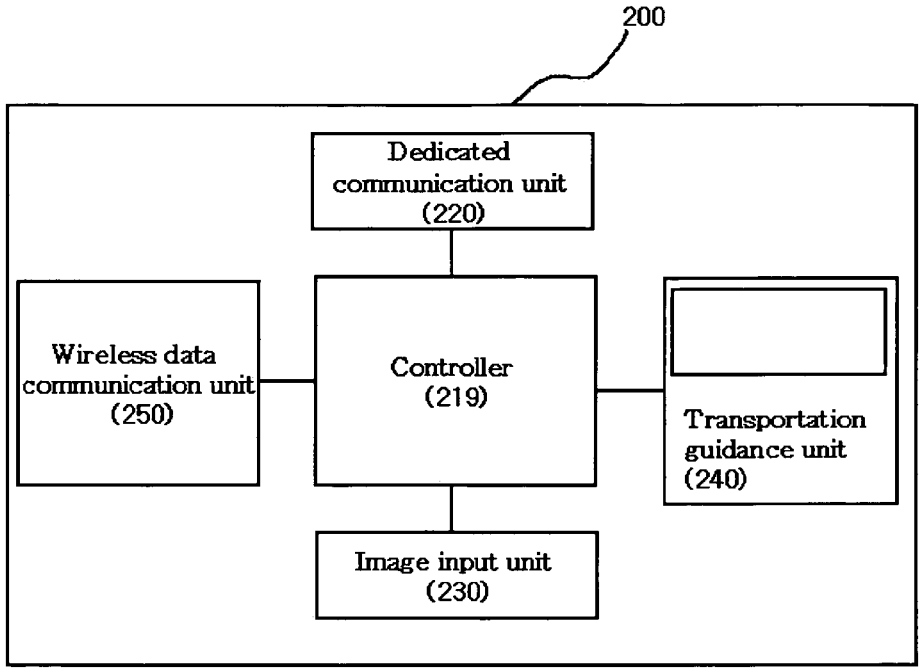
FIG. 3 is a diagram illustrating the configuration of a bus information guidance center of the public transportation system.

Referring to FIG. 3, the configuration of the transportation information guidance centers 200 will be described as follows.

Each of the transportation information guidance centers 200 comprises: a wireless data communication unit 250 to receive the bus information from the on-board terminal 300 and transmit the transportation information transmitted from the transportation management server 100 to the on-board terminal 300; a controller 210 to control transmission of the transportation information to the on-board terminal and display of the transportation guidance information on a transportation guidance unit 240 by transmitting processed bus information, which is obtained by adding time information and bus stop information to the bus information collected in the wireless data communication unit 250, to a dedicated communication unit 220, and by transmitting the transportation information and the transportation guidance information transmitted from the dedicated communication unit 220 to the wireless data communication unit 250 and the transportation guidance unit 240, respectively; the dedicated communication unit 220 to transmit the processed bus information to the transportation management server 100 and to receive the transportation information and the transportation guidance information from the transportation management server 100; the transportation guidance unit 240 to display the transportation guidance information so as to allow the passengers waiting at the bus stops to obtain the transportation guidance information; and an image input unit 230 to input various image information (for example, news, weather condition, advertisement, regional news) to be displayed on the transportation guidance unit 240.

The term "processed bus information" means the information obtained by adding time-related data and bus stop numbers to the bus information collected in the on-board terminal 300, in which the time-related data preferably comprises arrival and departure times of the associated bus at and from information collecting positions. In other words, when any of the buses arrives at any of the information collecting positions, an associated transportation information guidance center 200 transmits the processed bus information to the transportation management server 100 after primarily receiving and processing the bus information of the bus, and when the bus departs from this information collecting position, the transportation information guidance center 200 transmits another processed bus information to the server after secondarily receiving and processing the bus information of the bus. At this time, when calculating the transportation information using the collected bus information, it is preferable that calculation be based on the bus information collected at departure of the bus from the information collecting position.

The transportation management server 100 can recognize traveling locations of the buses depending on times by means of the bus information comprising data about information collecting times and information collecting bus stops.

Figure 7:
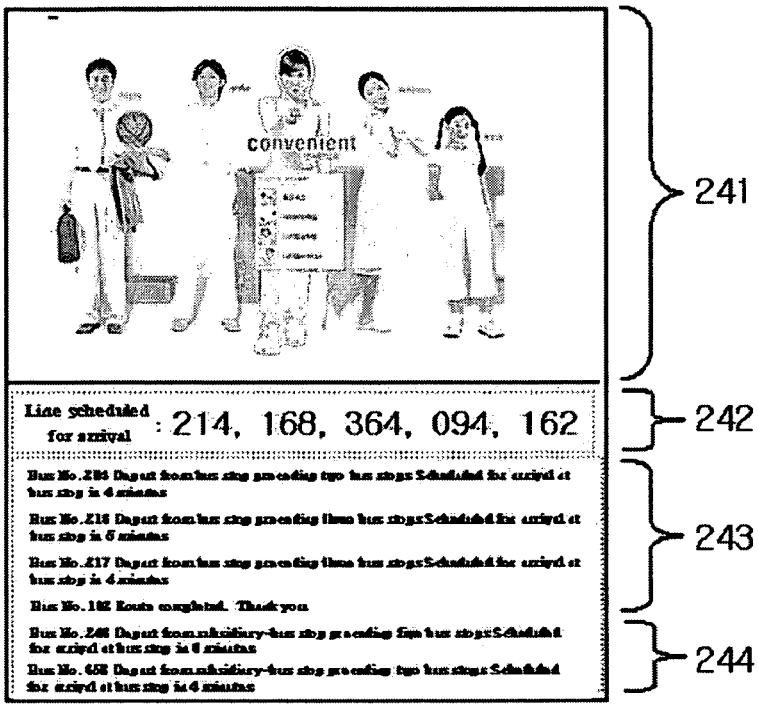
FIG. 7 is a view illustrating an example of a transportation guidance unit of the transportation information guidance center.

In FIG. 7, one example of the transportation guidance information displayed on the transportation guidance unit 240 is shown.

The transportation guidance information is displayed on the transportation guidance unit 240, and supplied to the passengers waiting at the bus stops. Referring to FIG. 7, the configuration of the transportation guidance information comprises an image display section 241 to display the various types of image information (for example, news, weather condition, advertisement, regional news) for advertisement and provision of information to the passengers waiting at the bus stops. The configuration further comprises a short distance arrival scheduled bus guidance section 242 to display an arrival schedule of the target bus at the associated bus stop, which can be provided when the bus will arrive at the associated bus stop shortly as the bus arrives at an immediately previous bus stop or is running at a near position in a predetermined distance or less from the associated bus stop, a long distance arrival scheduled bus guidance section 243 to display arrival schedules of all buses at the associated bus stop except for the short distance arrival scheduled bus, and a subsidiary-bus stop arrival scheduled bus guidance section 244 to display arrival schedules of other buses, which travel along the similar line corresponding to the target line, at the subsidiary-bus stop of the similar line.

The image input unit 230 serves as a route to create the images to be displayed on the image display section 241 of the transportation guidance unit 240. The image input unit 230 can display images via a digital storage medium (for example, CD-ROM drives, HDD drives, etc.) or via image data received through communication (for example, wire/wireless communication, satellite communication, mobile communication, etc.).

Meanwhile, it should be noted that collection of the bus information as to the buses traveling on the road is not performed only by the transportation information guidance centers 200 located at the bus stops. More specifically, in addition to the transportation information guidance centers 200 installed to the respective bus stops, at least one transportation information collecting device 400 is installed at a certain position on the line to receive the bus information of the buses traveling on the road. The transportation information collecting device 400 also collects the bus information from the on-board terminals 300, and transmits the processed bus information, obtained by adding the time-related information to the previous bus information, to the transportation management server 100. It also transmits the transportation information sent from the transportation management server 100 to the on-board terminal 300.

That is, as with the transportation information guidance centers 200, the transportation information collecting device 400 installed at the certain position excluding the bus stops has functions of receiving the bus information and transmitting the transportation information, except for display of the transportation guidance information for the passengers. Thus, the configuration of the transportation information collecting device 400 is the same as that of the transportation information guidance center 200 shown in FIG. 3 except for the image input unit 230 and the transportation guidance unit 240.

After receiving and processing the bus information, the transportation management server 100 supplies instructions for suitable adjustment of the distance between the buses, and at the same time, bus arrival information to the respective bus stops on the basis of the collected bus information.

Figure 4:
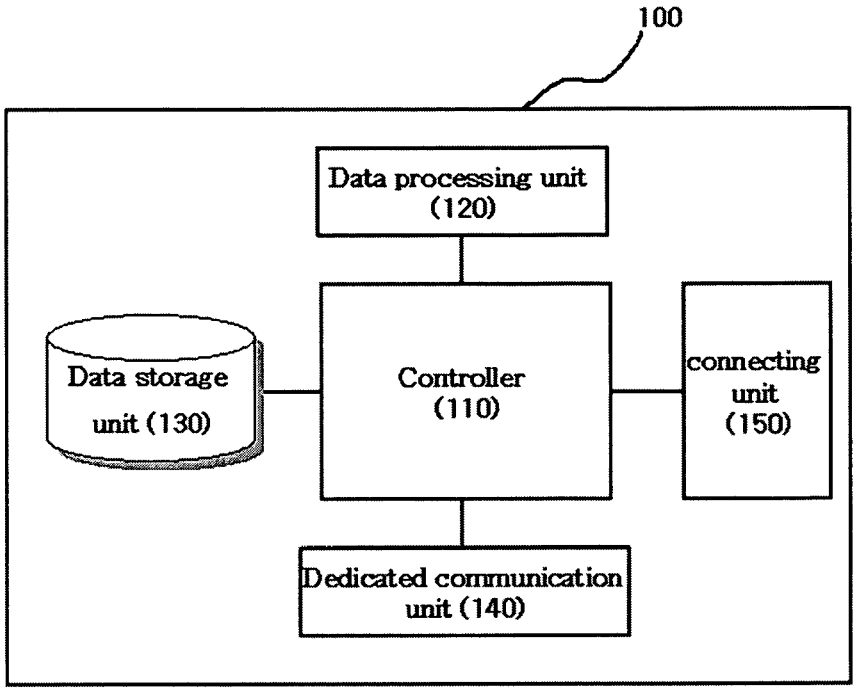
FIG. 4 is a diagram illustrating the configuration of a transportation management server of the public transportation system.

Referring to FIG. 4, the configuration of the transportation management server 100 will be described in detail. The transportation management server 100 comprises: a dedicated communication unit 140 to receive the collected and processed bus information from the transportation information guidance centers 200 and the transportation information collecting device 400 and to transmit the transportation information and the transportation guidance information created on the basis of the collected bus information to the transportation information guidance centers 200 or to the transportation information collecting device 400; a data processing unit 120 to create the transportation information and the transportation guidance information after analyzing the collected transportation information; a data storage unit 130 to store the collected bus information, the transportation information and transportation guidance information; a connecting unit 150 to supply the transportation information and the transportation guidance information to the company server 500, the public office server 600, and the additional service center server 700 via the Internet network; and a controller 110 to control the respective units described above to assist receipt of the bus information and creation of the transportation information and the transportation guidance information.

At this time, the information transmitted from the transportation management server 100 to the on-board terminals 300 of the target bus comprises various messages or traffic information received in the bus company of the target bus or in a transportation information center without being limited to the transportation information for adjusting the distance.

In addition to the collected bus information, the data storage unit 130 of the transportation management server 100 may store information as to a line of each bus, information as to traveling buses of each line, information as to an on-board terminal of each bus to travel on the target line, and information as to the transportation information guidance centers and the transportation information collecting devices on each line.

The transportation management server 100 may supply the transportation information and the transportation guidance information created on the basis of the collected bus information to the public as shared information through the Internet network. As shown in FIG. 1, the transportation management server 100 may help the bus company to establish a suitable management plan for the line by supplying the created information to the company server 500 which acts to manage traveling of the buses of the company. The transportation management server 100 may also help smooth transportation for government and public offices, large shopping malls or facilities by supplying the information to the public office server 600. Moreover, the transportation management server 100 supplies the information to the additional service center server 700 to allow any person to utilize the information with convenience through a personal computer or a mobile terminal.

Figure 5:
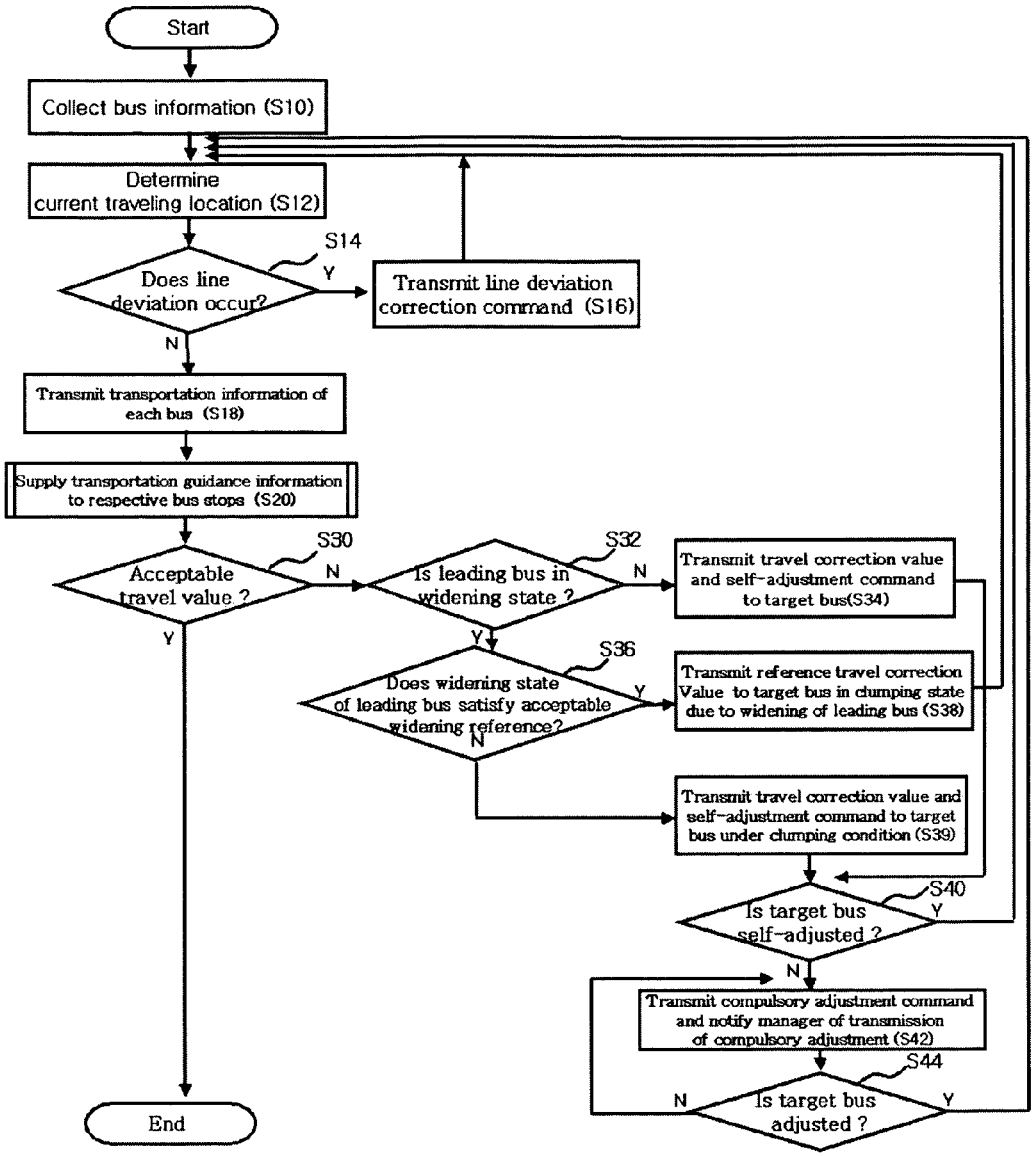
FIG. 5 is a flow diagram illustrating a method for controlling public transportation in accordance with one embodiment of the present invention.

Next, a method for controlling the public transportation system according to one embodiment of the invention will be described with reference to FIG. 5.

First, the transportation management server 100 collects bus information, which is transmitted from the on-board terminals 300 of public buses traveling on a line, through the transportation information guidance centers 200 and the transportation information collecting device 400, and stores the bus information in the data storage unit 130 (S10).

At Step S10, the bus information transmitted from the on-board terminal 300 comprises basic information including a bus number and a line number of an associated bus, road condition information as to construction and accident blocks, and bus condition information as to conditions of the bus such as last bus, defective bus or accident bus. After collecting the bus information of the buses, the transportation information guidance centers 200 or the transportation information collecting device 400 process the bus information after adding time-related data and collecting position information (such as a bus stop number or a collecting device number), and transmits the processed bus information to the transportation management server 100.

Next, the transportation management server 100 determines a current location of each bus traveling on the road in real time through the bus information collected from the on-board terminals 300 of the buses (S12).

Next, the transportation management server 100 retrieves bus allocation information of a target line on the basis of the current location of each bus traveling on the road, and determines whether there occurs line deviation at which a leading bus is passed by a following bus on the line (S14).

With a result of determination at Step S14, when the line deviation has occurred, the transportation management server 100 transmits a line deviation correction command to a surpassing bus to correct the line deviation (S16).

Meanwhile, the transportation management server 100 computes a satisfactory travel value and a travel correction value of each bus through the data processing unit 120 using the collected bus information, and transmits transportation information comprising the satisfactory travel value and the travel correction value to the on-board terminal 300 of each bus (S18).

The satisfactory travel value of a bus is calculated by the following Equation 1;

$$A=\{(a_{-1})+(a_{-2})+(a_{-3})\}/3 \quad (1)$$

wherein A indicates a satisfactory travel value of a target bus, $a_{-1}$ indicates a block travel time of a first leading bus from the target bus, $a_{-2}$ indicates a block travel time of a second leading bus from the target bus, and $a_{-3}$ indicates a block travel time of a third leading bus from the target bus.

Here, the block travel time "a" of each bus is a time obtained by subtracting an arrival schedule of the leading bus from an arrival schedule of the target bus at an identical information collecting position.

In Equation 1, the satisfactory travel value of the bus means an average block travel time of the leading buses.

The travel correction value of the bus is calculated by the following Equation 2;

$$\alpha=\{(a_{-1})+(a_{-2})+(a_{-3})\}/3-a \quad (2)$$

wherein $\alpha$ indicates a travel correction value of the target bus, and a indicates a block travel time of the target bus.

That is, the travel correction value in Equation 2 means a time obtained by subtracting the block travel time of the target bus from the average block travel time of the three leading buses.

Thus, the transportation information supplied to the target bus at Step S18 comprises information as to leading and following buses, information as to distances from the target bus to the leading and following buses, information as to travel values of the leading and following buses, information as to travel correction values of the leading and following buses, and information as to the travel correction value of the target bus. One example of the transportation information supplied to the target bus is shown in FIG. 8.

For reference, when the travel correction value is a positive value, the target bus must lower its driving speed by the travel value, and when the travel correction value is a negative value, the target bus must increase its driving speed by the target value.

In the following description, the block travel time of the target bus corresponding to a distance between the target bus and the leading bus will be defined as the travel value.

Thus, a driver of the target bus is informed of the transportation information through the on-board terminal 300, and can drive the bus on the basis of the travel values and the travel correction values of the leading and following buses, so that the distance between the buses can be safely and accurately adjusted.

Meanwhile, the transportation management server 100 transmits transportation guidance information comprising arrival schedule of the respective buses at an associated bus stop to the transportation information guidance centers 200 at the respective bus stops, in which the transportation guidance information is calculated on the basis of the block travel times of the respective buses, which are the travel values calculated using the collected bus information (S20).

The step of supplying the transportation guidance information to the respective bus stops at Step S18 will be described in detail in the following description.

The transportation management server 100 determines whether the target bus travels with an acceptable travel value or not, i.e., whether the target bus is in a normal traveling condition or not, on the basis of the bus information of the buses (S30).

Here, normality in traveling condition of the target bus (a) can be determined by the following Equation 3;

$$[\{(a_{-1})+(a_{-2})+(a_{-3})\}/3]\times 1.3 \geqq a \geqq [\{(a_{-1})+(a_{-2})+(a_{-3})\}/3]\times 0.7 \quad (1)$$

More specifically, according to Equation 3 for determining the normality in traveling condition, it is determined that the target bus is in the normal traveling condition when the travel value of the target bus is in the range of ±30% or more than an average block travel value of the three leading buses.

That is, if the target bus travels with a travel value greater than ±30% from the normal travel value, considered as an acceptable deviation of the distance, it is determined that the target bus travels out of the acceptable travel value. If the target bus travels with a travel value in the range of ±30%, i.e. if the target bus satisfies Equation 3, it is determined that the target bus is in the normal traveling condition, and the transportation management server 100 ends the process for determining normality in traveling condition of the target bus after repeating steps S10 to S20.

According to a result of determination at Step S30, if the target bus travels out of the acceptable travel value, the transportation management server 100 determines whether the leading bus is in a widening state with respect to the target bus or not (S32).

Here, the term "widening" means the case where the distance between buses is increased in comparison to a reference distance. Meanwhile, the term "clumping" described below means the case where the distance between the buses is decreased in comparison to the reference distance.

Here, a point of reference for determining the widening state is the travel value increased or decreased by 30% or more of the average travel value. That is, when the distance between the target bus and other buses is widened by 30% or more of the distance between other buses, it is referred to as the widening state.

According to a result of determination at Step S32, if the widening state does not occurs between the target bus and the leading bus, more specifically, if the target bus travels out of the acceptable travel value without widening of the leading bus, the transportation management server 100 calculates the travel correction value as at Step S18 described above, and then transmits the travel correction value and a self-adjustment command, which urges the driver of the target bus to adjust the distance with reference to the travel correction value, to the on-board terminal 300 of the target bus (S34).

As shown in FIG. 8, the self-adjustment command and the travel correction value are displayed on the bus information and command guidance section 331 and the self-travel correction value guidance section 336 of the on-board terminal 300 to urge the driver of the target bus to adjust the distance according to the travel correction value.

According to a result of determination at Step S32, if the widening state occurs between the target bus and the leading bus, more specifically, if the widening state occurs between the target bus and the leading bus under a condition that the target bus travels out of the acceptable travel value, the transportation management server 100 determines whether widening of the leading buses satisfies an acceptable widening reference or not.

If widening of the leading buses satisfies the acceptable widening reference, i.e. if a normal widening state occurs between the leading buses, the transportation management server 100 calculates a travel correction value of the target bus as at Step S18, and transmits the travel correction value to the on-board terminal 300 of the target bus for reference (S38).

Here, the term "acceptable widening reference" means a reference, at which, even if the widening state occurs during travel of the buses, the transportation management server 100 does not transmit a distance adjustment command to the target bus irrespective of possibility of clumping between the target bus and the following bus in order to prevent delay of an overall line travel time, under conditions that the widening state is caused by the driver of the target bus or road conditions cause a certain bus traveling on a specific block to fall behind.

That is, if a widening degree of the leading bus is within the acceptable widening reference, the transportation management server 100 transmits only the travel correction value to the target bus for reference of the driver of the target bus without the self-adjustment command, and if the widening degree between the target bus and the leading bus is above the acceptable widening reference, the transportation management server 100 transmits the travel correction value together with the self-adjustment command to the target bus.

The acceptable widening reference of Step S36 is defined by the following Equation 4;

(Travel value of a bus in widening state)+(Travel value of a bus in clumping state)≦(Average travel value of leading buses with respect to the bus in widening state)×2.

More specifically, if the sum of travel values of two buses is 200% or less of the average travel value of the leading-buses in the widening state with respect to the target bus, the transportation management server 100 transmits the travel correction value to the target bus without the self-adjustment command irrespective of the possibility of clumping between the target bus and the following bus caused by widening of the leading buses. Here, the average travel value of the leading buses in the widening state with respect to the target bus is the satisfactory travel value of the leading buses. In other words, even if the widening state occurs during travel of the buses, the transportation management server 100 does not transmit the self-adjustment command to the target bus in order to adjust the distance between the target bus and the following bus, under the condition that the widening state is caused by the driving technique of the driver of the target bus or the road conditions of the specific block on the road.

On the contrary, according to a result of a determination at Step S36, if the leading bus causes the widening state with respect to the target bus, and the widening degree of the leading bus does not satisfy the acceptable widening reference, the transportation management server 100 transmits the travel correction value and the self-adjustment command to the target bus under the clumping state (S39).

Meanwhile, unlike the travel correction value described above in Equation 2, the travel correction value transmitted to the target bus under the clumping state due to widening of the leading bus is calculated by the following Equation 5;

Travel correction value transmitted to a bus in clumping state due to widening of a leading bus=(Satisfactory travel value of the leading bus)×2−travel value of the leading bus−travel value of the bus in clumping state.

After transmitting the travel correction value and the self-adjustment command at Steps S34 and S39, the transportation management server 100 reviews the traveling condition of the target bus using the bus information transmitted from the on-board terminal 300 of the target bus desired to travel according to the pre-transmitted travel correction value and the self-adjustment command, and determines whether the traveling condition of the target bus is corrected (self-adjusted) or not (S40). Then, if the traveling condition of the target bus is corrected according to the self-adjustment command, the process of the transportation management server 100 returns back to Step 12, and continues the process.

However, if the traveling condition of the target bus is not corrected to satisfy the self-adjustment command, the transportation management server 100 transmits a compulsory adjustment command together with another travel correction value according to the traveling condition to the on-board terminal 300 of the target bus, and stores a traveling record of the target bus according to transmission of the compulsory adjustment command for notification to a manager of the target bus (S42).

At this time, the compulsory adjustment command and the travel correction value based on the compulsory adjustment command are displayed on the bus information and command guidance section 331 and the self-travel correction value guidance section 336 of the on-board terminal 300 as shown in FIG. 8. At the same time, the transportation management server 100 notifies a target line manager of the transmission of compulsory adjustment command on the basis of the driving records of the target bus to allow the manager to manage the line.

In addition, the transportation management server 100 reviews the traveling condition of the target bus using the bus information transmitted from the on-board terminal 300 of the target bus desired to travel according to the compulsory adjustment command, and determines whether the traveling condition of the target bus under the compulsory adjustment command is corrected (self-adjusted) or not (S44). Then, if the traveling condition of the target bus is corrected according to the compulsory adjustment command, the transportation management server 100 returns back to Step 12 to continue the process. If the traveling condition of the target bus is not corrected to satisfy the compulsory adjustment command, the transportation management server 100 alerts the manager to control the line through repetitious transmission of additional compulsory adjustment commands and notification of the command to the manager.

Figure 6:
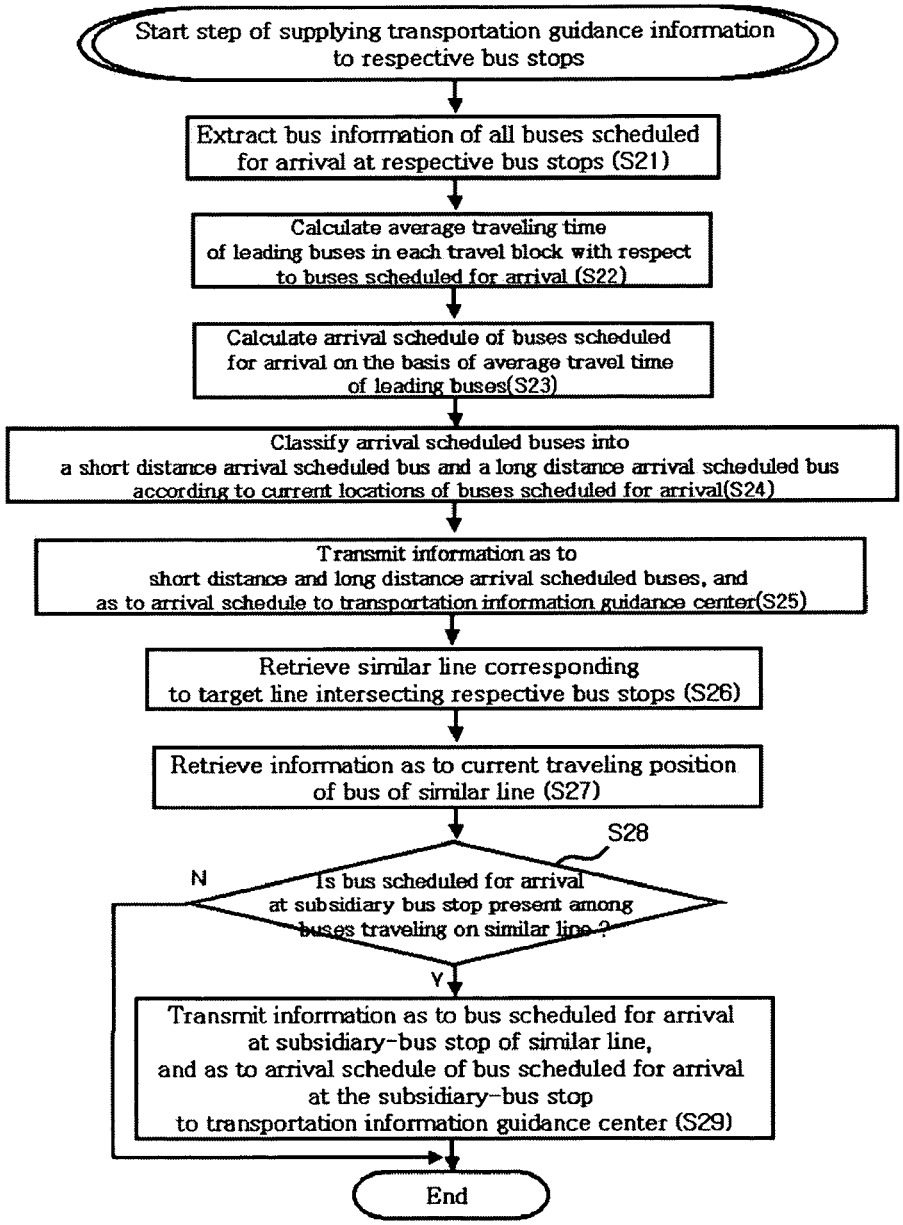
FIG. 6 is a detailed flow diagram illustrating the step of providing transportation guidance information to respective bus stops.

Next, the step of supplying the transportation guidance information to the respective bus stops at Step S20 will be described in detail with reference to FIG. 6.

First, using the bus information transmitted from the on-board terminal 300 of the target bus traveling on the line and then collected through the transportation information guidance centers 200 or the transportation information collecting device 400, the transportation management server 100 retrieves and extracts the bus information of all buses scheduled for arrival at the respective bus stops where the transportation information guidance centers 200 are installed (S21).

Then, the transportation management server 100 calculates an average traveling time of leading buses in each travel block with respect to the buses scheduled for arrival at the respective bus stops (i.e. a satisfactory travel value of the buses scheduled for arrival at the respective bus stops) using the extracted bus information (S22).

Then, the transportation management server 100 calculates arrival schedules of the buses scheduled for arrival at the respective bus stops on the basis of the average travel time of the leading buses in each travel block (S23).

More specifically, an average travel time of the buses, which have traveled an associated block and arrived at the bus stop before the arrival scheduled bus, is determined as a scheduled travel time of the buses scheduled for arrival, and the arrival schedule is calculated using the average travel time of the three leading buses with respect to the arrival schedule bus.

Next, the transportation management server 100 classifies the arrival scheduled buses into a short distance arrival scheduled bus and a long distance arrival scheduled bus according to current locations of the buses scheduled for arrival at the respective bus stops (S24).

A point of reference for classification of short and long distances can be a single block between a current bus stop and a previous bus stop or can be determined according to a different metric. In FIG. 7, one example of classifying arrival scheduled buses at a bus stop one stop prior to a current bus stop as the short distance arrival scheduled bus is shown.

Next, the transportation management server 100 transmits information as to the short distance arrival scheduled bus and the long distance arrival scheduled bus, and information as to the arrival schedule of the buses scheduled for arrival to the transportation information guidance centers 200 of the respective bus stops (S25).

As a result, the transportation information guidance center 200 of each bus stop displays the bus information and the arrival schedule information included in the transportation guidance information on the short distance arrival scheduled bus guidance section 242 and the long distance arrival scheduled bus guidance section 243 of the transportation guidance unit 240 shown in FIG. 7.

At this time, if there is no change in information as to positions (bus stops) of the bus, which is displayed on each transportation information guidance center 200, change of a displaying period on the transportation information guidance center 200 is performed in real time by automatically decreasing the period in the transportation information guidance center 200, thereby enhancing reliability for guidance of arrival schedule. In addition, it is preferable that the transportation information guidance center 200 display the information in a flowing manner according to display items in order to sufficiently utilize a limited display space of the transportation guidance unit 240. Moreover, for guidance of the short distance arrival scheduled bus, the transportation information guidance centers 200 are controlled to stop guidance of the arrival schedule, and to allow guidance of imminent arrival circumstance of the target bus, thereby avoiding erroneous guidance of arrival schedule due to errors or unexpected circumstances.

Meanwhile, the transportation management server 100 retrieves lines intersecting each bus stop, and a similar line corresponding to a target line intersecting an associated bus stop (S26).

Here, it should be noted that any of buses traveling on the similar line does not stop the associated bus stop.

Although Step S26 is described as retrieving the lines for each bus stop and the similar line, it is preferable that information as to the lines for the bus stops, and as to the similar line be preset in practice.

Then, the transportation management server 100 retrieves information as to a current traveling position of a bus of the similar line (S27), and determines whether the bus scheduled for arrival at a bus stop of the similar line near the associated bus stop, i.e. a subsidiary bus stop, is present among the buses traveling on the similar line (S28).

With a result of determination at Step S28, if it is determined that the bus scheduled for arrival at the subsidiary bus stop is present among the buses traveling on the similar line, the transportation management server 100 transmits information as to the bus traveling on the similar line, and information as to arrival schedule of the bus scheduled for arrival at the subsidiary-bus stop to the transportation information guidance center 200 of the associated bus stop.

Information as to arrival schedule of the bus traveling on the similar line corresponding to the target line among the buses scheduled for arrival at the subsidiary-bus stop is displayed on the subsidiary-bus stop arrival scheduled bus guidance section 244 of the transportation guidance unit 240 shown in FIG. 7 to provide the bus information and the arrival schedule of the bus.

As a result, the passengers waiting at the associated bus stop can obtain the information as to the arrival schedule of the similar line traveling bus at the subsidiary-bus stop near the associated bus stop, as well as the information as to the buses scheduled for arrival at the associated bus stop.

As apparent from the above description, the system and method for public transportation control according to the present invention control a target bus running on the road to maintain a suitable distance with respect to a leading or following bus on the basis of traveling data of the buses after collecting the traveling data of the buses, and at the same time, transmit transportation information of a target bus on the basis of the collected traveling data to the respective bus stops so as to notify passengers waiting at the bus stops of an arrival schedule of the target bus at the bus stops, thereby preventing clumping of the buses and intentional traveling delay while allowing the passengers to efficiently use a wait time through notification of an accurate bus information of the buses.

In addition, the present invention enables any passenger to receive information as to buses scheduled for arrival at respective bus stops, information as to travel value of the respective buses, etc., which are calculated with reference to the data collected from the buses, through PCs or mobile terminals, thereby enhancing the utility of the public transportation.

Moreover, the present invention helps drivers of the buses to grasp an entire transportation flow and to release impatience through transmission of distance adjustment information to the drivers in real time, thereby reducing traffic accidence while enhancing quality of service for users.

Moreover, the present invention provides arrival schedules of the public buses at the respective bus stops to the passengers waiting at the bus stops, thereby providing passenger distribution effect.

Moreover, the present invention provides information as to buses traveling on a similar line intersecting the subsidiary-bus stop to the passengers, thereby increasing selection of the buses by the passengers, and maximizing use of the time for waiting the bus.

Moreover, the present invention enables a bus company to utilize traveling data as materials for continuous education of the drivers and management of the lines through analysis of the traveling data.

It should be understood that the embodiments and the accompanying drawings have been described for illustrative purposes and the present invention is limited by the following claims. Further, those skilled in the art will appreciate that various modifications, additions and substitutions are allowed without departing from the scope and spirit of the invention as set forth in the accompanying claims.

What is claimed is:

1. A public transportation control system, comprising:

an on-board terminal equipped to each public bus traveling on a road to transmit bus information of an associated bus and to display transportation information for adjusting a traveling distance between the buses after receiving the transportation information created based on the bus information from outside through wireless communication;

a plurality of transportation information guidance centers installed to bus stops to transmit the bus information to the outside after collecting the bus information transmitted from the on-board terminals of the buses, and to transmit transportation information of the associated bus to the on-board terminal of the associated bus while supplying transportation guidance information of the associated bus to passengers waiting at the bus stops after receiving the transportation information and the transportation guidance information created on the basis of the bus information from the outside through the wireless communication;

a transportation management server to store the bus information after receiving the bus information transmitted from the on-board terminals through the transportation information guidance centers via a dedicated communication network, and to transmit the transportation information and the transportation guidance information to the transportation information guidance centers installed to the bus stops after creating the transportation information for adjustment of the distance between the buses and the transportation guidance information for guidance of arrival schedules of the buses; and at least one transportation information collecting device installed at a certain position on the road, where the public buses travel, to transmit the bus information to the transportation management server after collecting the bus information transmitted from the on-board terminals, and to transmit the transportation information of the associated bus to the on-board terminal of the associated bus after receiving the transportation information created on the basis of the transmitted bus information from the transportation management server;

wherein the bus information collected by the on-board terminal and stored in the transportation management server comprises basic information as to a bus number and a line number of the associated bus, road condition information as to construction and accident blocks, and bus condition information as to whether the associated bus is a last bus, a defective bus or an accident bus.

2. The system as set forth in claim 1, wherein the transportation information created by the transportation management server and transmitted to the on-board terminal of the associated bus comprises bus and manager command information as to the basic information of the associated bus, updated data receipt time, and a command from a manager of a line of the associated bus, leading/following-bus information as to a leading bus and a following bus with respect to the associated bus, distance guidance information as to distances from the associated bus to the leading bus and to the following bus, traveling distance guidance information as to block travel times corresponding to the distances from the associated bus to the leading bus and to the following bus, leading/following-bus travel correction value guidance information as to travel correction values of the leading and following buses, and self-travel correction value guidance information as to a travel correction value of the associated bus.

3. The system as set forth in claim 2, wherein the transportation guidance information transmitted to the transportation information guidance centers after being created by the transportation management server comprises short distance arrival schedule information to notify that, since the associated bus arrives at a bus stop immediately preceding an associated bus stop or is a predetermined distance or less from the associated bus stop, the bus will arrive at the associated bus stop shortly, long distance arrival schedule information to notify arrival schedule of all public buses at the associated bus stop except for the short distance arrival scheduled bus, and subsidiary-bus stop arrival schedule information to notify arrival schedule of other buses at a subsidiary bus stop near the associated bus stop, the other buses traveling along a similar line corresponding to a target line.

4. The system as set forth in claim 3, wherein the transportation management server supplies the transportation information and the transportation guidance information to a bus company of the associated bus or citizens as shared information through an Internet network after creating transportation information and the transportation guidance information.

5. The system as set forth in claim 4, wherein, among the transportation information created by the transportation management server and transmitted to the on-board terminal, the block travel time corresponding to the distance between the associated bus and the leading bus is calculated by subtracting a time when the associated bus passes a bus information collecting position from a time when the leading bus passes the position, a satisfactory travel value of the associated bus is calculated using an average block travel time of a predetermined number of leading buses with respect to the associated bus, and the travel correction value of the target bus is calculated by subtracting the block travel time corresponding to the distance between the associated bus and the leading bus from the satisfactory travel value.

6. The system as set forth in claim 5, wherein, among the transportation information created by the transportation management server and transmitted to the on-board terminal, the travel correction value transmitted to the associated bus when the associated bus is in clumping state due to widening of the leading bus is calculated by subtracting the block travel times of the leading bus and the associated bus from two times of the satisfactory travel value of the leading bus.

7. A method for controlling public transportation, comprising the steps of:

a) collecting bus information transmitted from on-board terminals of public buses through at least one transportation information collecting mechanism, and storing the bus information;

b) determining a current traveling position of each bus using positions of collecting the bus information;

c) determining whether there occurs a line deviation at which a leading bus is passed by a following bus on a line on the basis of the current traveling positions of the respective buses, followed by transmitting a correction command to the on-board terminal of a target bus through the transportation information collecting mechanism if line deviation occurs;

d) calculating a satisfactory travel value and a travel correction value of each bus using the collected bus information, followed by transmitting transportation information comprising the satisfactory travel value and the travel correction value to the on-board terminal of each bus through the transportation information collecting mechanism;

e) determining whether the target bus is in a normal traveling condition within an acceptable degree or not on the basis of the collected bus information; and f), if the target bus travels out of the acceptable degree, calculating a travel correction value of the target bus, and transmitting the travel correction value and a self adjustment command to the on-board terminal of the target bus through the transportation information collecting mechanism, the self adjustment command being provided for urging a driver of the target bus to adjust the traveling condition with reference to the travel correction value, the above steps being performed by a transportation management server.

8. The method as set forth in claim 7, wherein the bus information collected by the on-board terminal and stored in the transportation management server at the step a) comprises basic information as to a bus number and a line number of an associated bus, road condition information as to construction and accident blocks, and bus condition information as to whether the associated bus is a last bus, a defective bus or an accident bus.

9. The method as set forth in claim 8, wherein the transportation information transmitted to the on-board terminal at the step d) comprises bus and manager command information as to the basic information of the target bus, updated data receipt time, and a command from a manager of the line of the target bus, leading/following-bus information as to a leading bus and a following bus with respect no the target bus, distance guidance information as to distances from the target bus to the leading bus and no the following bus, traveling distance guidance information as to block travel times corresponding no the distances from the target bus to the leading bus and to the following bus, leading/following-bus travel correction value guidance information as to travel correction values of the leading and following buses, and self-travel correction value guidance information as to a travel correction value of the target bus.

10. The system as set forth in claim 9, wherein, among the transportation information transmitted to the on-board terminal at the step d), the block travel time corresponding to the distance between the target bus and the leading bus is calculated by subtracting a time when the target bus passes a bus information collecting point from a time when the leading bus passes the bus information collecting point, the satisfactory travel value of the target bus is calculated using an average block travel time of a predetermined number of leading buses with respect to the target bus, and the travel correction value of the target bus is calculated by subtracting the block travel time corresponding to the distance between the target bus and the leading bus from the satisfactory travel value.

11. The method as set forth in claim 10, wherein, when determining whether the target bus is in the normal traveling condition within the acceptable degree or not at the step e), a determination is made that the target bus is in the normal traveling condition when the block travel time of the target bus is in the range of ±30% or more than an average block travel value of the three leading buses.

12. The method as set forth in claim 11, further comprising the steps of:

g), if the target bus travels our of the acceptable degree on the basis of the collected bus information, determining whether the leading bus is in a widening state with respect to the target bus or not;

h) if the widening state does not occurs between the target bus and the leading bus, performing the step f), and if the leading bus is in the widening state with respect to the target bus, determining whether the widening condition of the leading bus satisfies a predetermined acceptable widening reference or not;

i) if the widening state of the leading bus satisfies the acceptable widening reference, calculating a travel correction value of the target bus, followed by transmitting the travel correction value to the on-board terminal of the target bus for reference of the driver of the target bus without a distance adjustment command; and j) if the widening state of the leading bus does not satisfy the acceptable widening reference, calculating a travel correction value for widening the distance between the target bus and the following bus to correct clumping state of the target bus due to widening of the leading bus, followed by transmitting the travel correction value and the self-adjustment command to the on-board terminal of the target bus in the clumping state through the transportation information collecting mechanism, the self-adjustment command being provided to urge the driver of the target bus to adjust the traveling condition of the target bus on the basis of the travel correction value, the above steps being performed by the transportation management server.

13. The method as set forth in claim 12, further comprising the steps of:

k), after transmitting the travel correction value and the self-adjustment command at the steps f) and i), reviewing the traveling condition of the target bus using the bus information transmitted from the on-board terminal of the target bus directed to travel according to the travel correction value and the self-adjustment command, followed by determining whether the traveling condition of the target bus is corrected (self-adjusted) or not; and l), if the traveling condition of the target bus is not corrected to satisfy the self-adjustment command, transmitting a compulsory adjustment command together with another travel correction value according to the traveling condition to the on-board terminal of the target bus, and storing a traveling record of the target bus according to transmission of the compulsory adjustment command for notifying a manager of the target bus, the above steps being performed by the transportation management server.

14. The method as set forth in claim 13, wherein, when determining whether the leading bus is under the widening state with respect to the target bus or not at the step g), it is determined that the leading bus is in the widening state when the block travel time of the target bus is increased or decreased by ±30% or more of an average block travel time of the three leading buses, and when determining whether the widening state of the leading bus satisfies the acceptable widening reference or not at the step h), it is determined that the widening state of the leading bus satisfies the acceptable widening reference when a sum of the block travel times of the widening bus and the target bus under the clumping state is two times or less of the average block travel time of the three leading buses under the widening state with respect to the target bus.

15. The method as set forth in claim 14, wherein a travel correction value for widening the distance between the target bus and the following bus transmitted to the target bus when the target bus is in the clumping state due to widening of the leading bus is calculated by subtracting the block travel times of the leading bus and the target bus from two times of the satisfactory travel value of the leading bus.

16. The method as set forth in claim 15, further comprising the steps of:

m-1) retrieving and extracting the bus information of all buses scheduled for arrival at the respective bus stops through the bus information transmitted from the on-board terminals of the buses traveling on the road;

m-2) calculating an average traveling time of leading buses in each travel block with respect to the buses scheduled for arrival at the respective bus stops through the extracted bus information;

m-3) calculating arrival schedules of the buses scheduled for arrival at the respective bus stop on the basis of the average travel time of the leading buses in each travel block;

m-4) classifying the arrival scheduled buses into a short distance arrival scheduled bus and a long distance arrival scheduled bus according to current locations of the buses scheduled for arrival at the respective bus stops; and m-5) transmitting information about the short distance arrival scheduled bus and the long distance arrival scheduled bus, and information about the arrival schedule of the buses scheduled for arrival to transportation information guidance centers of the respective bus stops, the above steps being performed by the transportation management server.

17. The method as set forth in claim 16, wherein the transportation guidance information transmitted to the transportation information guidance centers at the step m-5) comprises short distance arrival schedule information to notify that, since the target bus arrives at a bus stop immediately preceding an associated bus stop or is running at a near position in a predetermined distance or less from the associated bus stop, the bus will arrive at the associated bus stop shortly, long distance arrival schedule information to notify arrival schedule of all public buses at the associated bus stop except for the short distance arrival scheduled bus, and subsidiary-bus stop arrival schedule information to notify arrival schedule of other buses at a subsidiary bus stop near the associated bus stop, the other buses traveling along a line corresponding to a target line.

18. The method as set forth in claim 17, further comprising the steps of:

m-6) retrieving lines intersecting the respective bus stops, and the similar line corresponding to the target line intersecting the associated bus stop;

m-7) retrieving information about a current traveling position of public buses traveling on the similar line, followed by determining whether a bus scheduled for arrival at the subsidiary bus stop near the associated bus stop is present among the buses traveling on the similar line or not; and m-8) calculating an arrival schedule of the bus scheduled for arrival at the subsidiary bus stop of the similar line near the associated bus stop among the buses traveling on the similar line, followed by transmitting information about the bus of the similar line scheduled for arrival at the bus stop of the similar line near the associated bus stop, and the arrival schedule of the bus scheduled for arrival at the subsidiary bus stop of the similar line near the associated bus stop to the transportation information guidance center of the associated bus stop, the above steps being performed by the transportation management server.

* * * * *

UNITED STATES PATENT AND TRADEMARK OFFICE

CERTIFICATE OF CORRECTION

PATENT NO. : 7,394,404 B2
APPLICATION NO. : 11/228799
DATED : July 1, 2008
INVENTOR(S) : Jae-Ho Kim It is certified that error appears in the above-identified patent and that said Letters Patent is hereby corrected as shown below:

Column 10, line 16, please delete the equation shown as Equation 3 and replace it with the following:

-- $[\{(a-1)+(a-2)+(a-3)\}/3] \times 1.3 \geq a \geq [\{(a-1)+(a-2)+(a-3)\}/3] \times 0.7$ --

Column 11, line 34, please delete the equation shown as Equation 4 and replace it with the following:

-- (Travel value of a bus in widening state) + (Travel value of a bus in clumping state) ≤ (Average travel value of leading buses with respect to the bus in widening state) × 2 --

Column 17 - Claim 9 line 34, line 36, line 38, please delete "no" and insert -- to -- therefore.

Column 18 - Claim 12, line 3, please delete "our" and insert -- out -- therefore.

Signed and Sealed this

Ninth Day of September, 2008

JON W. DUDAS
*Director of the United States Patent and Trademark Office*